United States Patent [19]

Enzo

[11] 4,409,996

[45] Oct. 18, 1983

[54] DEVICE FOR FITTING FILTERS TO CIGARETTES

[75] Inventor: Seragnoli Enzo, Bologna, Italy

[73] Assignee: G.D. Societá per Azioni, Bologna, Italy

[21] Appl. No.: 260,772

[22] Filed: May 5, 1981

[30] Foreign Application Priority Data

Jun. 4, 1980 [IT] Italy ..... 48872 A/80

[51] Int. Cl.[3] ..... A24C 5/52

[52] U.S. Cl. ..... 131/94; 131/95

[58] Field of Search ..... 131/93, 94, 95

[56] References Cited

U.S. PATENT DOCUMENTS 3,077,889 2/1963 Patterson ..... 131/94

FOREIGN PATENT DOCUMENTS 682379 2/1965 Italy ..... 131/94

*Primary Examiner*—Vincent Millin

*Attorney, Agent, or Firm*—Browdy and Neimark

[57] ABSTRACT

A device for fitting filters to cigarettes by glued joining bands, in which a peripherally grooved carrier roller transfers groups composed of two cigarettes aligned axially with a filter to a rolling position where a counter-rolling element defines, through one of its fixed counter-rolling surfaces and in combination with the cylindrical surface of the carrier roller, a passage in the region of which rolling of the bands around the groups occurs.

The counter-rolling element is provided with at least two counter-rolling surfaces which, in turn, can be carried into the rolling position with the surface momentarily not in use for rolling cigarettes being cleaned, the cleaning taking place without disrupting cigarette production.

10 Claims, 2 Drawing Figures

DEVICE FOR FITTING FILTERS TO CIGARETTES

BACKGROUND OF THE INVENTION

The subject of the invention is a device for fitting filters to cigarettes, or more precisely, a device in which cigarettes and filters are connected one to the other by means of glued joining bands.

DESCRIPTION OF THE PRIOR ART

In accordance with the known art the fitting of the filters to the cigarettes is done by what are known as filter fitting machines, the various phases of which are outlined briefly below.

The cigarettes are placed two by two in axial alignment and there between is interposed, in the same axial alignment and in contact with the extremities of the cigarettes, a filter cutting twice the length of that needed for one cigarette. The group constituted by the two cigarettes and by the cutting is joined by means of a glued band of paper material that is wound to cover the filter cutting and each of the two cigarette extremities over an area of approximately 3 millimeters.

The said operations are generally performed, for example in the way described in U.S. Pat. No. 3,527,234, with the cigarettes and filter cuttings held by suction on the periphery of a longitudinally grooved, rotating, carrier drum.

The said adhesive joining bands are fed onto the periphery of the carrier drum, and are held in position by suction.

A fixed concave plate, coaxial to the carrier drum and separated from it by a distance that closely corresponds to the diameter of one cigarette, engages through friction with the said groups and causes them to roll onto the bands that then wind around them, thereby joining one to the other.

With a device of the type described, one problem lies in the fact that the said concave plate fouls easily and thus jeopardizes the efficiency of the entire filter fitting machine. It is, in fact, inevitable that traces of adhesive cling to the plate when the machine is running, and that these traces collect dust, fragments of cigarettes and, not infrequently, also bands that have failed to stick properly to the groups.

Because of the foregoing it is necessary to periodically shut down for a certain interval of time both the filter fitting machine and the cigarette manufacturing machine upstream thereof, in order to clean the plate, which requires laborious operations because of the poor accessibility of the plate.

SUMMARY OF THE INVENTION

The object of the invention is, therefore, to make available a device of the type mentioned, in which the problems due to the fouling of the said concave plate are reduced to a minimum.

A further object of the invention is, in accordance with the preceding object, to make available a device of the type mentioned, in which the cleaning and eventual replacement of the said concave plate can be carried out, without losses of time, while the filter fitting machine is in operation.

These and other objects are all attained with devices according to the invention for fitting filters to cigarettes. The invention comprises means for transferring in succession, in a transverse direction, groups formed by at least one cigarette and one filter cutting placed in end contact, the transfer means being provided with what is called a rolling surface that has equidistant housings for the groups, and suction means for restraining joining bands for the groups. The invention further comprises what is known as a counter rolling element that defines, in the region of what is called a rolling position, through one of its counter rolling surfaces and in combination with the transfer means, a passage of a size close to but a little less than the diameter of the said groups. Essential features of the invention include that the counter-rolling element has at least two counter-rolling surfaces and that means are provided for carrying the counter-rolling surfaces, individually and at successive times, into the rolling position to permit simultaneous cleaning of the surface or surfaces not actively engaged at the rolling position.

BRIEF DESCRIPTION OF THE DRAWINGS

Further characteristics and advantages will emerge more obviously from the detailed description that follows of two embodiments of the invention, illustrated purely as unlimited examples in the accompanying drawings, in which.

DESCRIPTION OF THE PREFERRED EMBODIMENTS

Figure 1:
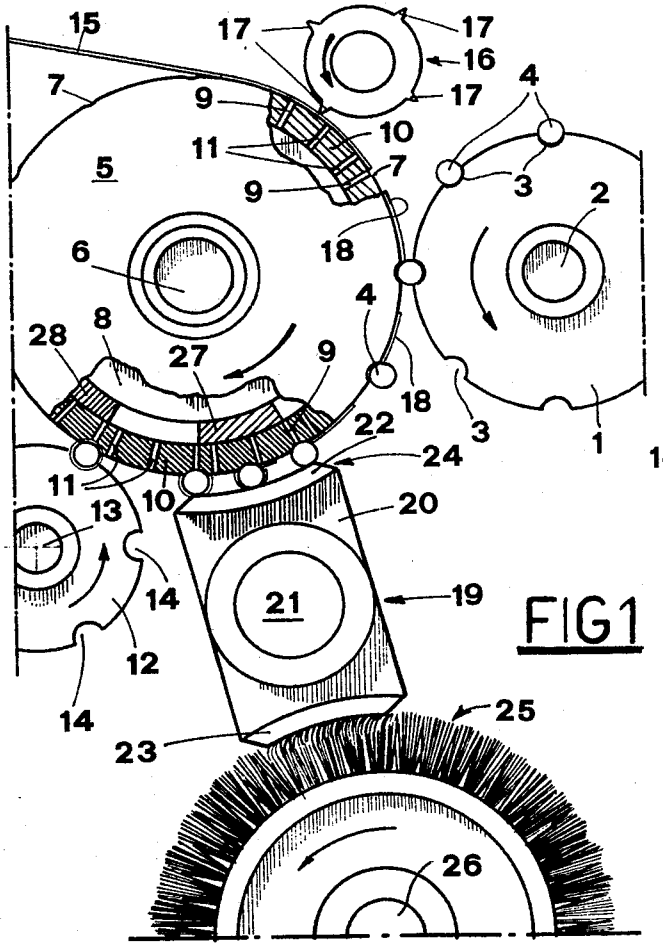
FIG. 1 shows, in a front diagrammatic view partially in sectional form, a first embodiment of the invention.

With reference to FIG. 1, shown at 1 is a horizontal axis roller or drum, supported by a shaft 2 and driven, by non-illustrated means, with a rotary motion in a counter-clockwise direction.

The periphery of the roller 1 is formed with equidistant longitudinal grooves 3 inside of which are restrained by suction groups of the type described in introductory parts above, shown generally at 4, constituted by two cigarettes with a filter cutting interposed of a length twice that of the filter to be fitted to one cigarette.

Close to the roller 1, on the left in FIG. 1, there is a roller or drum 5, supported by a shaft 6 parallel to the shaft 2, and provided with peripheral grooves 7. The roller 5 rotates clockwise at the same peripheral speed as the roller 1, the grooves 7 therein mating with the aforementioned grooves 3 in succession. Drum 5 has an internal cylindrical cavity or chamber 8 that is connected in a non-illustrated manner to a source of suction.

The grooves 7 communicate, via holes or ducts 9 that pass through the cylindrical wall 10 of the roller 5, with the chamber 8. The wall 10 also has passing through it, between each pair of grooves 7, holes or ducts 11.

Shown at 12 there is a horizontal axis roller, supported by a shaft 13 close to the lower lefthand area of the roller 5. The roller 12 is provided with equidistant peripheral grooves 14 whose inter-spacing corresponds to that of the grooves 3 and 7. The roller 12 rotates counter-clockwise at the same peripheral speed as the roller 5, the grooves 14 therein mating in succession with the grooves 7.

A strip 15 of paper material, glued at the top and taken from a reel that is not illustrated in FIG. 1, is fed by non-illustrated means tangentially onto the periphery of the roller 5 at a linear speed that is less than the peripheral speed of the latter.

The edge of the strip 15 in contact with the roller 5 is maintained adherent therewith through suction applied via the holes 11.

Upstream of the area where the rollers 1 and 5 are adjacent, the strip 15 is cut by a rotating knife or cutting means 16 provided peripherally with four equidistant blades 17 that cooperate with the periphery of the roller 5 for the cutting action.

The knife 16, given counter-clockwise rotary motion, separates in succession from the strip 15, bands 18 destined to connect one to the other the elements in the groups 4.

Because of the previously mentioned difference between the peripheral speed of the roller 5 and the linear velocity of the strip 15, the front edge of the latter slides constantly on the roller 5 in such a way that, after being cut, the bands, suitably spaced one with respect to the other, attach themselves to the said roller 5.

Placed in proximity to the roller 5, between the rollers 1 and 12, there is a counter-rolling element that is shown generally at 19. This comprises a support member 20 keyed to a shaft or carrier means 21 parallel to the shaft 6.

The support member 20 carries two identical concave plates 22 and 23 that are placed symmetrically with respect to one axial plane of the support member 20.

The plate 22 is coaxial with the roller 5 and it occupies a position, defined a rolling position, shown at 24.

The plate 22 and the roller 5 are spaced one from the other at a distance close to but a little less than the diameter of one group 4, and the arc length bordering them is virtually identical to the pitch between two grooves 7.

The maximum radial volume of the counter-rolling element 19 is such that, as it rotates around the axis of the shaft 21, no interference occurs between the concave plates 22–23 and the roller 5.

A cylindrical brush 25, fixedly mounted on a shaft 26 parallel to the shaft 6, is placed in peripheral contact with the concave plate 23 and is given rotary motion by non-illustrated drive means.

Before examining the operation of the invention device, it should be noted that, as shown in FIG. 1, the suction action exerted by the surface of the roller 5 through the holes 9 and 11 is missing in the region of the said rolling position 24 and immediately downstream of the area of proximity between the rollers 5 and 12, because of the presence in the chamber 8 of fixed arcuate walls 27 and 28, respectively, coaxial with the roller 5 and adjacent to the inner surface of the cylindrical wall 10 in the region of said areas.

With the device in operation, the groups 4 are transferred in succession from the grooves 3 of the roller 1 to the grooves 7 of the roller 5 and are held by the latter because of the suction applied through the holes 9.

Once the bands 18 have been separated from the strip 15 by the knife 16, they remain attached to the roller 5 because of the suction applied through the holes 11. Each of them is positioned between two successive grooves 7 and has its front edge, with reference to the direction of rotation of the roller 5, at the side of the groove 7 placed downstream.

Upon reaching the rolling position 24, the groups 4 engage by friction with the surface called the counter-rolling surface of the plate 22 and roll onto the corresponding bands 18 which then wind around them and connect one element to the other.

During the said rolling operation, each group 4 protrudes from its groove 7 and then retracts, once the operation has been completed, into the subsequent groove 7.

It is obvious that, for the groups 4 to be able to exit grooves 7 in the way described without suffering damage, the grooves 7 have to be of a very limited depth.

Following the described rolling operation, the groups 4 reach the roller 12 where they are housed in the grooves 14 and are carried to subsequent non illustrated processing stations.

In accordance with what has already been seen, while the plate 22 performs, in the position 24, its rolling action on the groups 4, the cylindrical brush 25 can, by being rotated as indicated by the arrow, attend to the cleaning of the plate 23 while the filter fitting machine is running.

A simple rotation through 180° of the counter rolling element 19 around the axis of the shaft 21 enables the plates 22 and 23 to change positions.

During periodical or even accidental periods of non operation of the filter fitting machine, the alternation of the two plates 22 and 23 can take place in a fully automatic fashion or can even be achieved manually.

The operation of cleaning the plate that is placed in the non-operative position can naturally be performed, instead of with the cleansing means that comprise the rotating brush 25, with any other mechanical means, or even by hand.

It should also be noted that, according to one advantageous characteristic of the invention, the plate that is placed in the non-operative position can also be changed over with another while the filter fitting machine is in a running condition. This possibility is particularly appreciated in the quite frequent case of the rolling surfaces of the plates 22 and 23 being provided with minute needles, that deteriorate rather quickly, the needles being provided to perforate the groups 4 in order to create what are known as "aerated cigarettes".

In other embodiments of the invention, the counter-rolling element can be provided with more than two counter rolling plates.

Figure 2:
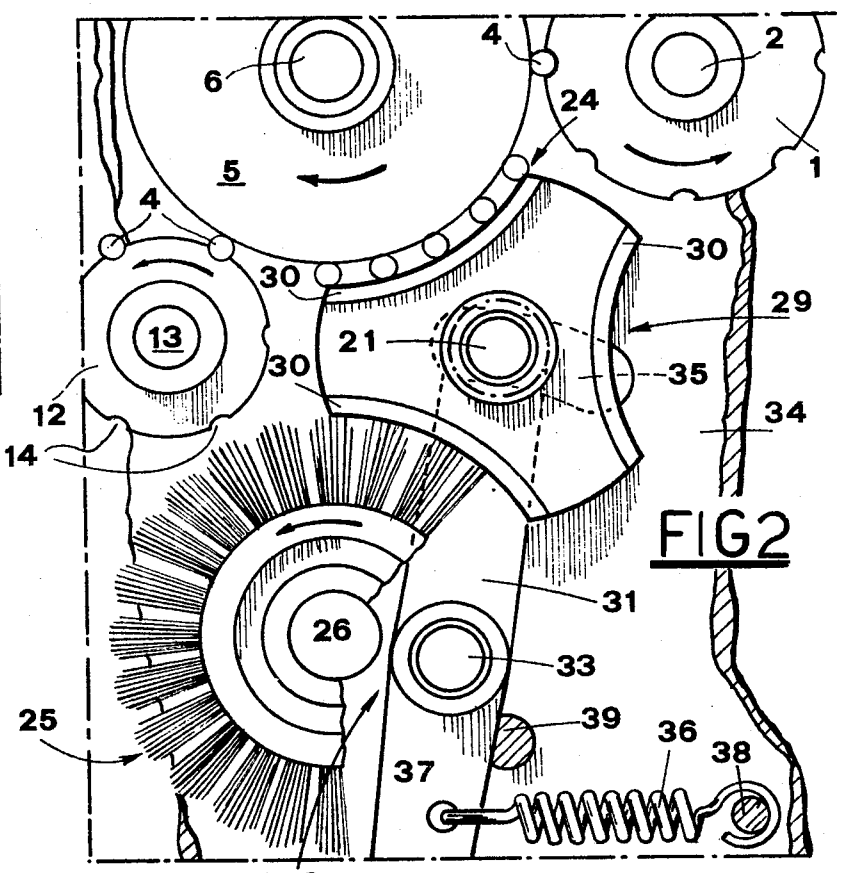
FIG. 2 shows, in a front diagrammatic view shows, a second embodiment.

FIG. 2 shows, purely as an example, a counter rolling element 29 equipped with three plates 30 that are angularly equidistant one with respect to the others.

Should the roller 5 be flanked by a plate 30 along an arc of a length such as not to allow the counter rolling element 29 to rotate freely around the axis of the shaft 21, the possibility is envisaged of utilizing actuator means with which to displace the element 29 away from the position 24 so that the rotation may take place.

For this purpose, the shaft 21 in FIG. 2 is supported in a rotatable fashion on the upper extremity of an arm 31 of a two-arm lever 32 of virtually vertical extension.

The intermediate area of the lever 32 is pivotally connected to a pin 33, parallel with the shaft 21 and integral with a vertical wall 34 that is part of the frame of the filter fitting machine. The wall 34 also supports rotatably, in a non-illustrated way, the shaft 26 of the brush 25 and is provided with an arcuate aperture or slot 35 having its center of curvature on the axis of the pin 33, through which the shaft 21 passes.

A tension spring 36 links the lower arm 37 of the lever 32 with a pin 38 integral with the wall 34 and to the right of the lever 32.

In the operating condition of the device, the action of the spring 36 on the lever 32 is counteracted by a stop pad 39 fixed to the wall 34.

The described deviation of the counter-rolling element 29 from the position 24 is achieved, in an automatic fashion or manually, through a rotation clockwise of the lever 32 around the axis of the pin 33.

Naturally, leaving unchanged the principles of the invention, numerous variations to the devices described herein purely as unlimited examples would be possible, without in any way deviating from the protection afforded to the invention.

What is claimed is:

1. A device for fitting filters to cigarettes, comprising means for transferring in succession, in a transverse direction, groups formed by at least one cigarette and one filter cutting placed in end to end contact, said transfer means comprising a rolling surface that has equidistantly spaced means for housing said groups, and suction means for holding joining bands for said groups on said rolling surface; a counter-rolling element mounted in spaced relation to said rolling surface, said counter-rolling element comprising a plurality of separate counter-rolling surfaces, said device comprising an active rolling position defined by one only of said separate counter-rolling surfaces which in combination with said transfer means defines a passage of a size slightly less than the diameter of one of said groups; and means for moving each of said plurality of separate counter-rolling surfaces individually and at successive times into said active rolling position while all of the remaining ones of said separate counter-rolling surfaces are in inactive position.

2. The device according to claim 1, wherein said rolling surface is defined by a cylindrical surface of a roller, and said counter-rolling element is mounted for rotation around an axis.

3. The device according to claim 2, wherein said counter-rolling element plurality of separate counter-rolling surfaces are equidistantly spaced from said axis.

4. The device according to claim 1, wherein means are provided to clean said counter-rolling surfaces while they are in said inactive position.

5. The device according to claim 4, wherein said cleaning means comprise at least one cylindrical brush, and means drive said brush in rotation about its own axis.

6. The device according to claim 1, wherein said counter-rolling element is movably mounted with respect to said transfer means, and actuator means to move said counter-rolling element away from and towards said transfer means.

7. The device according to claim 6, wherein said counter-rolling element comprises three of said separate counter-rolling surfaces.

8. The device according to claim 1, wherein said separate counter-rolling surfaces are each part of a separate member with respect to said counter-rolling element, and said inactive position being a relatively easily accessible location on said device, whereby a member having a worn counter-rolling surface can be replaced and cleaned on said counter-rolling element while another one of said separate surfaces is actually working at said rolling position.

9. In a device for fitting filters to cigarettes of the type wherein a band is wound about and is adhesively joined to a group formed of at least one cigarette and one filter cutting by rolling the group and the band at a rolling position, said rolling position being at least partially defined by counter-rolling means, the improvement wherein said counter-rolling means comprises a counter-rolling element comprising a plurality of separate counter-rolling surfaces, means to move said counter-rolling element with respect to said rolling position so that one only of said separate surfaces is in said rolling position and the others of said separate surfaces are in a relatively easily accessible inactive position, one only of said separate surfaces being able to fit said filters to said cigarettes only when located in said rolling position, all of said others of said separate surfaces not in said rolling position and in said inactive position being unable to fit said filters to said cigarettes, and means to clean said surfaces at said inactive position.

10. The device of claim 9, wherein said surfaces are detachable from said element, and wherein a worn surface can be replaced at said inactive position while another of said surfaces is working at said rolling position.

* * * * *

UNITED STATES PATENT AND TRADEMARK OFFICE

CERTIFICATE OF CORRECTION

PATENT NO. : 4,409,996
DATED : October 18, 1983
INVENTOR(S) : Enzo SERAGNOLI

It is certified that error appears in the above-identified patent and that said Letters Patent are hereby corrected as shown below:

Title page, line 2, "Enzo" should read --Seragnoli--
Title page, [75] Inventor should read --Enzo Seragnoli--

Signed and Sealed this

*Second* Day of *April 1985*

[SEAL]

*Attest:*

DONALD J. QUIGG

*Attesting Officer* *Acting Commissioner of Patents and Trademarks*